US008668626B1

(12) United States Patent
Horowitz et al.

(10) Patent No.: US 8,668,626 B1
(45) Date of Patent: Mar. 11, 2014

(54) WIRELESS PRESSURE SENSING ROCK CLIMBING HANDHOLD AND DYNAMIC METHOD OF CUSTOMIZED ROUTING

(76) Inventors: Matanya B. Horowitz, Louisville, CO (US); Anil S. Damle, Colorado Springs, CO (US); Mark G. VanKempen, Boulder, CO (US)

( * ) Notice: Subject to any disclaimer, the term of this patent is extended or adjusted under 35 U.S.C. 154(b) by 473 days.

(21) Appl. No.: 12/985,520

(22) Filed: Jan. 6, 2011

Related U.S. Application Data

(60) Provisional application No. 61/298,189, filed on Jan. 25, 2010.

(51) Int. Cl.
*A63B 9/00* (2006.01)

(52) U.S. Cl.
USPC ..... 482/37; 482/35; 482/36

(58) Field of Classification Search
USPC ..... 482/23, 35–37
See application file for complete search history.

(56) References Cited

U.S. PATENT DOCUMENTS

2010/0004098 A1* 1/2010 Hensley ..... 482/37

* cited by examiner

*Primary Examiner* — Glenn Richman
(74) *Attorney, Agent, or Firm* — G. F. Gallinger

(57) ABSTRACT

A handhold for rock climbing for attachment to a constructed wall with a screw, for wireless communication with a remote computer, comprises: a) a body having a rear generally flat side portion and an integrated peripheral side portions wherein an upper peripheral portion is adapted to be grasped, said body having an interior cavity; b) an elongate cylindrical hole extending through the body sized to closely receive the screw for attachment to the constructed wall; c) a circuit, generally positioned within the interior cavity, containing a microprocessor, a pressure sensor to detect force on the handhold created by a user, a light emission device, a wireless transmission antenna; and d) a power source. In conjunction with the remote computer the circuit can be activated, the light emission device can be lit, and information generated in the handhold can be restored for recall at a later time.

14 Claims, 2 Drawing Sheets

WIRELESS PRESSURE SENSING ROCK CLIMBING HANDHOLD AND DYNAMIC METHOD OF CUSTOMIZED ROUTING

PRIOR APPLICATION

The priority of U.S. Provisional Application No. 61/298,189 filed on Jan. 25, 2010 by Matanya B. Horowitz et al. is claimed.

FIELD OF THE INVENTION

This invention relates to systems used to create of rock climbing routes on constructed walls. More particularly this invention relates to dynamic creation of a route for a particular user, registered with the system, who has inputted individual route creation parameters. The system then creates a new route based on this information, indicating the resulting route by lighting up the handholds present on the route. The user may then begin their ascension, which is recorded through a combination of pressure sensors on each handhold as well as video cameras recording the rock climbing wall. The resulting route information is stored and may recalled for playback as well as scoring and evaluation.

BACKGROUND OF THE INVENTION

The present invention is intended for use in the sport of Rock Climbing. In particular, this invention relates to an electronic lighting, sensing, and control system that lights up handholds dynamically to create new routes, and to record the climbing of these routes. The sport of rock climbing involves the ascension of routes on an artificial wall, usually mimicking a natural rock face, through the placement of handholds. These handholds come in a number of configurations and are placed to create a route of specific difficulty.

At present most installations contain a large number of handholds with specific designators, such as colored tape, that allow for specific routes to be shown on a wall with only a chosen set of handholds. A number of routes may be simultaneously present on a given wall, with the climbers only using a designated set. Difficulties with this implementation include the inability to enforce restriction on movement to a single route as well as the degradation of the marking mechanisms through continued use.

A difficulty facing businesses providing rock climbing facilities is that on a given wall a limited space for routes is available. There is a question as to the balance of difficulty in the routes that are placed on a given wall. A balance must be struck for routes that are for beginners as well as for experts. Furthermore, frequent climbers at a given facility can exhaust the supply of routes. Changing routes is a time consuming and expensive process, providing one of the largest operational costs of the facility.

The rock climbing sport has a competitive aspect, with competitions available that grade climbers on a number of factors. Among these are speed and difficulty. Speed competitions require climbers to climb a designated route as quickly as possible. Difficulty competitions require climbers to ascend a route as far as possible. Each is currently judged by a panel of referees.

OBJECTS OF THE INVENTION

It is an object of this invention to disclose a wireless handhold which may be internally lit, according to instructions given by an external processing unit, or computer. The wireless handholds can be physically configured so that they can replace handholds on an existing rock climbing wall. The use of wireless technology also minimizes the cost of installing or retrofitting the system to an existing wall. The use of a computer enables dynamic and convenient changes in the displayed route as well as the ability to customize or select a route based on a particular user profile which includes an individual user's biometric data such as reach and a stored route climbing history. It is yet a further object of this invention to disclose a convenient method of wirelessly identifying a next user. Users might select a specific route which was previously created, or alternatively vary a specific route say for example by adding or removing specific handholds. The computer will then give each handhold specific instructions, indicating whether they are on a given route or not. If the handholds are on a specific route they will be lit in a specific color to indicate that they are legal holds. It is an object of this invention to provide feedback to the user relating to force, and direction of that force exerted on each handhold. It is yet a final object of this invention to facilitate sophisticated and recorded judging of competitors. Use of handholds not on a designated route can result in them being lit and flashing, providing feedback to the user when they are lightly touched, and if force exerted thereon exceeds a threshold amount, then the illegal handhold can remain lit, signaling disqualification of a user. For contests which require time measurement the computer can provide accurate time measurement. In the event of a dispute, information including a recording of the climb captured through video cameras, and handhold force data can be reviewed.

One aspect of this invention provides for a handhold for rock climbing configured to be attached with a screw to a constructed wall, for wireless communication with a remote computer, comprises: a) a body having a rear generally flat side portion and an integrated front and surrounding peripheral side portions wherein an upper peripheral portion is adapted to be grasped and support weight, said body having an interior cavity; b) an elongate cylindrical hole extending through the body sized to closely receive the screw to attach the body to the constructed wall; e) a circuit, generally positioned within the interior cavity, containing a microprocessor, a pressure sensor to detect force on the handhold created by a user, a light emission device, a wireless transmission antenna; and d) a power source. In conjunction with the remote computer the circuit can be activated, the light emission device can be lit, and information generated in the handhold can be restored for recall at a later time.

Most preferably, the power source comprises a rechargeable battery positioned in the cavity and wherein the handhold further comprises two recessed contacts in a lower side portion of the body of the handhold to facilitate electrical connection and battery charging without removal of the handhold from the constructed wall.

Most generally, a method of generating a customized route on a rock climbing wall, with a handhold as described in claim 1, wherein the remote computer is initialized by entering handhold locations on the wall, after all handholds are mounted in fixed locations on the wall, comprising the following steps: a) inputting a complete list of identification numbers assigned to each handhold on the wall to the remote computer; b) using a camera to provide a first image of the entire wall having all of the handholds mounted thereon; c) cycling the computer through the list of identification numbers, i) first sending a lightup command to an identification number on the list, ii) then if acknowledgment is received, capturing a lit handhold image for that identification number, and then, iii) comparing the image of the lit handhold image with the first image to thereby associate a location with that identification number; and, d) providing that if no lit image is received this will be reported and the computer will then continue to the next identification number. A table of all handholds, identified by their identification number, and including their locations on the wall is thereby created for subsequent use when creating a route.

Various other objects, advantages and features of this invention will become apparent to those skilled in the art from the following description in conjunction with the accompanying drawings.

FIGURES OF THE INVENTION

Figure 1:
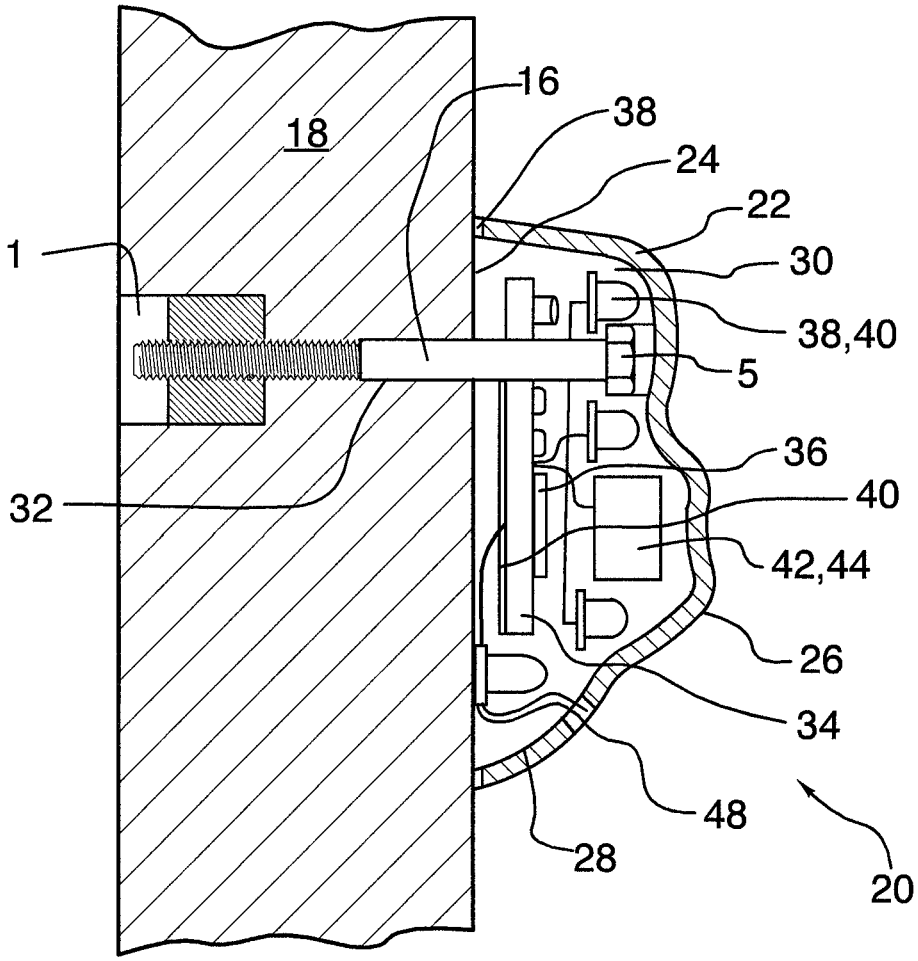
FIG. 1 is a cross sectional view of a wireless handhold mounted on a constructed rock climbing wall.
Figure 2:
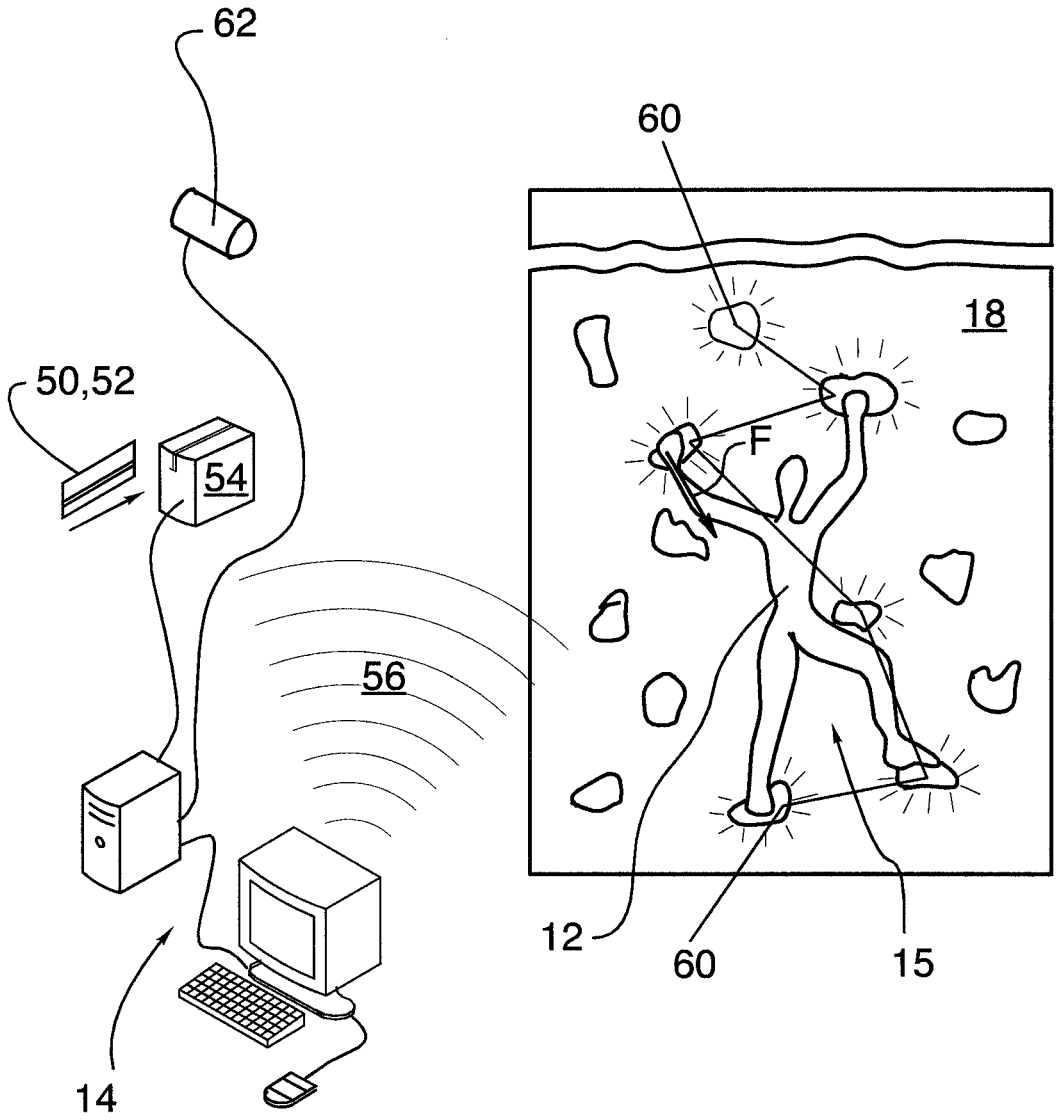
FIG. 2 is a perspective view of a user ascending a portion of the constructed rock climbing wall.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a cross sectional view of a wireless handhold 20 mounted on a constructed rock climbing wall 18. Most generally, the wireless handhold 20 for rock climbing is configured to be attached with a screw 16 to a constructed wall 18, for wireless communication with a remote computer 14, comprises: a) a body 22 having a rear generally flat side portion 24 and an integrated front side portion 26 and surrounding peripheral side portions 28 wherein an upper peripheral portion 28 is adapted to be grasped and support weight, said body 22 having an interior cavity 30; b) an elongate cylindrical hole 32 extending through the body 22 sized to closely receive the screw 16 to attach the body 22 to the constructed wall 18; c) a circuit 34, generally positioned within the interior cavity, containing a microprocessor 36, a pressure sensor 38 having a portion thereof attached to the constructed wall 18 to detect force on the handhold 20 created by a user 12, a light emission device 38, a wireless transmission antenna 40; and, d) a power source 42. In conjunction with the remote computer 14 the circuit 34 can be activated, the light emission device 38 can be lit, and information generated in the handhold 20 can be restored for recall at a later time. Within this specification a pressure sensor 38 is intended and defined to include a strain gauge (not shown).

Most preferably, the power source 42 comprises a rechargeable battery 44 positioned in the cavity 30 and the handhold 20 further comprises two recessed contacts 48 in a lower side portion of the body 22 of the handhold 20 to facilitate electrical connection and battery 44 charging without removal of the handhold 20 from the constructed wall 18. There may be multiple pressure sensors 38 placed at different locations adjacent to the edge of the handhold 20 to quantitatively measure the amount of force F, and the direction at which that force F is applied by a user 12 to the handhold 20. If the shape of the handhold 20 and hole 32 extending therethrough is configured to replicate that of an existing handhold 20 on an existing wall 18 used for climbing, then the existing wall 18 can be readily retrofitted with wireless handholds 20.

Most generally, a method of generating a customized route 60 on a rock climbing wall 18, with a handhold 20 as described above, wherein the remote computer 14 is initialized by entering handhold 20 locations on the wall 18, after all handholds 20 are mounted in fixed locations on the wall 18, comprises the following steps: a) inputting a complete list of identification numbers assigned to each handhold 20 on the wall 18 to the remote computer 14; b) using a camera 62 to provide a first image of the entire wall 18 having all of the handholds 20 mounted thereon; c) cycling the computer 14 through the list of identification numbers, i) first sending a lightup command to an identification number on the list, ii) then if acknowledgment is received, capturing a lit handhold 20 image for that identification number, and then, iii) comparing the image of the lit handhold 20 image with the first image to thereby associate a location with that identification number; and, d) providing that if no lit image is received that this will be reported, and the computer 14 will then continue to the next identification number. A table of all handholds 20, identified by their identification number, and including their locations on the wall 18 is thereby created for subsequent use when creating a route 60.

Most preferably a required user 12 information profile 50 may be inputted by the user swiping an identification card 52 over a card reader 54. Then the computer 14 can download the user information profile 50 comprising name, biometric information, a history of routes climbed from storage, and possibly other preferences. It is noted that the user 12 profile would typically include height and reach. Other preferences might include repetitions of a route 60 before advancing to a more difficult route 60. The remote computer 14 is programmed to create a route 14 based on parameters generated from the user 60 profile and the table of all handholds 60, including their locations on the wall 18; so that selected handholds 20 that most closely comply with, but do not exceed the parameters, are caused to light up thereby differentiating them from those handholds 20 not on the route 60.

It is an easy matter to program either the computer 14 or the microprocessor 36 to provide handhold 20 route 60 feedback to the user 12 through the Light Emitting Diode 40 on the handhold 20 gripped, and/or through sound 56 remotely emitted. The computer 14 can also be programmed to provide grip feedback to the user 12 based on inputted pressure sensor 38 data received from the sensors 38 placed at different locations on the edge of the handhold 20. For example, a handhold 20 which was not on the designated route might flash, and an alarm might sound if the handhold had less than a threshold force exerted thereon. The computer 14 can also be programmed to provide ascension time.

In the most preferred embodiment of the invention the computer 14 is programmed to allow users 12 to select a specific route 60 which was previously created. The computer 14 is also programmed to allow users 12 to vary a specific route 60 by adding or removing specific handholds 20. Additional feedback can be provided to users by programming the computer 14 to automatically start recording an ascension on video camera 62 when it is began, and to stop recording when it is completed, so that a user 12, or a judge (not shown) in a contest could subsequently review the ascension captured through the video camera 62. When permanent power wiring is not provided to the handholds 20, and when the power source 42 comprises a rechargeable battery 44 positioned in the handholds 20, it is noted that the operating facility, would want to include the step of programming the computer 14 to automatically enter a sleep mode to conserve battery 44 power after a specified period of inactivity.

The wireless handhold 20 and the system of dynamic system of customized route 60 creation are a great advantage not only to the users 12, but additionally to facility operators, who benefit from the increased interest of the users 12. The wireless handholds 20 and method described herein enable routes 60 to be instantaneously varied no cost! Accordingly, routes 60 can be varied not only to accommodate many different individual users 12 but additionally routes 60 can even be varied multiple times for a particular user 12 to achieve progress in incremental steps. For example the computer 14 may be programmed to vary a route 60 when a specified number of repetitions of the route 60 have occurred, and a specified ascension time has been achieved. Users 12 could be routinely provided feedback of their ascension time, and what ascension time they would be required to advance to the next level. Users 12 appreciate more feedback, and prefer to climb different walls 18, and it is a source of interest and camaraderie for users 12 to compare their performance with other users 12 they know.

While the invention has been described with preferred specific embodiments thereof, it will be understood that this description is intended to illustrate and not to limit the scope of the invention, which is defined by the following claims.

We claim:

1. A method of generating a customized route on a rock climbing wall, with a wireless handhold for rock climbing of the type having, a) a body having a rear generally flat side portion and an integrated front and surrounding peripheral side portions wherein an upper peripheral portion is adapted to be grasped and support weight, said body having an interior cavity, b) an elongate cylindrical hole extending through the body sized to closely receive a screw to attach the body to a constructed wall, c) a circuit positioned, generally positioned within the interior cavity, containing a microprocessor, a pressure sensor having a portion thereof attached to the constructed wall to detect force on the handhold created by a user, a light emission device, a transmission antenna for wireless communication with a remote computer, and d) a power source; so that in conjunction with the remote computer the circuit can be activated, the light emission device can be lit, and information generated in the handhold can be stored for recall at a later time;

wherein the remote computer is initialized by entering handhold locations on the wall, after all handholds are mounted in fixed locations on the wall, comprising the following steps:

a) inputting a complete list of identification numbers assigned to each handhold on the wall to the remote computer;

b) using a camera to provide a first image of the entire wall having all of the handholds mounted thereon;

c) cycling the computer through the list of identification numbers, i) first sending a lightup command to an identification number on the list, ii) then if acknowledgment is received, capturing a lit handhold image for that identification number, and then, iii) comparing the image of the lit handhold image with the first image to thereby associate a location with that identification number;

d) providing that if no lit image is received that this will be reported and the computer will then continue to the next identification number;

so that a table of all handholds, identified by their identification number, and including their locations on the wall is thereby created for subsequent use when creating a route.

2. A method of generating a customized route on a rock climbing wall, as in claim 1, further comprising the step of inputting a user information profile by requiring the user to swipe an identification card over a card reader so that the computer can download the user information profile comprising name, biometric information, a history of routes climbed from storage, and possibly other preferences.

3. A method of generating a customized route on a rock climbing wall, as in claim 2, wherein the computer is programmed to create a route based on parameters generated from the user profile and the table of all handholds, including their locations on the wall; so that selected handholds that most closely comply with, but do not exceed the parameters, are caused to light up thereby differentiating them from those handholds not on the route.

4. A method of generating a customized route on a rock climbing wall, as in claim 2, further comprising the step of programming the computer to provide handhold route feedback to the user through the Light Emitting Diode on the handhold gripped, and through sound remotely emitted.

5. A method of generating a customized route on a rock climbing wall, as in claim 2, further comprising the step of programming one of the computer and the microprocessor to provide grip feedback to the user based on inputted pressure sensor data received from the sensors placed at different locations on the edge of the handhold.

6. A method of generating a customized route on a rock climbing wall, as in claim 2, further comprising the step of programming the computer to provide climb feedback to the user including climb time and a climb rating quantifying the climb difficulty.

7. A method of generating a customized route on a rock climbing wall, as in claim 2, further comprising the step of allowing users to select a specific route which was previously created.

8. A method of generating a customized route on a rock climbing wall, as in claim 2, further comprising the step of allowing users to vary a specific route by adding or removing specific handholds.

9. A method of generating a customized route on a rock climbing wall, as in claim 1, further comprising the step of programming the computer to automatically start recording an ascension on video camera when it is began and to stop recording when it is completed, so that a user, or a judge in a contest could subsequently review the ascension captured through video cameras.

10. A method of generating a customized route on a rock climbing wall, as in claim 2, when permanent power wiring is not provided to the handholds, and wherein the power source comprises a rechargeable battery in the handhold, further comprising the step of programming the computer to automatically enter a sleep mode to conserve battery power in the handholds after a specified period of inactivity.

11. A method of generating a customized route on a rock climbing wall, with a wireless handhold for rock climbing of the type having, a) a body having a rear generally flat side portion and an integrated front and surrounding peripheral side portions wherein an upper peripheral portion is adapted to be grasped and support weight, said body having an interior cavity, b) an elongate cylindrical hole extending through the body sized to closely receive a screw to attach the body to a constructed wall, c) a circuit positioned, generally positioned within the interior cavity, containing a microprocessor, a pressure sensor having a portion thereof attached to the constructed wall to detect force on the handhold created by a user, a light emission device, a transmission antenna for wireless communication with a remote computer, and d) a power source; so that in conjunction with the remote computer the circuit can be activated, the light emission device can be lit, and information generated in the handhold can be stored for recall at a later time; comprising the steps of:

i) inputting a table of all handholds, including their locations on the wall to a remote computer;

ii) inputting a user information profile comprising a name, biometric information, and possibly other preferences to the computer; and, iii) programming the computer to create a route based on parameters generated from the user profile and the table of all handholds, including their locations on the wall; so that selected handholds that most closely comply with, but do not exceed the parameters, are caused to light up thereby differentiating them from those handholds not on the route; and, iv) programming the computer to automatically start recording an ascension on a video camera when it is began and to stop recording when it is completed, so that a user, or a judge in a contest could subsequently review the ascension captured through video cameras.

12. A method of generating a customized route on a rock climbing wall, as in claim 11, further comprising the step of programming the computer to provide handhold route feedback to the user through the Light Emitting Diode on the handhold gripped, and through sound remotely emitted.

13. A method of generating a customized route on a rock climbing wall, as in claim 11, further comprising the step of programming one of the computer and the microprocessor to provide grip feedback to the user based on inputted pressure sensor data received from the sensors placed at different locations on the edge of the handhold.

14. A method of generating a customized route on a rock climbing wall, as in claim 11, further comprising the step of programming the computer to provide climb feedback to the user including climb time and a climb rating quantifying the climb difficulty.

* * * * *